US010736434B1

(12) United States Patent
Kinion

(10) Patent No.: US 10,736,434 B1
(45) Date of Patent: Aug. 11, 2020

(54) MECHANICAL BED MATTRESS AND FRAME ENCASEMENT COVER

(71) Applicant: Gary Kinion, Farmington, AR (US)

(72) Inventor: Gary Kinion, Farmington, AR (US)

( * ) Notice: Subject to any disclaimer, the term of this patent is extended or adjusted under 35 U.S.C. 154(b) by 0 days.

(21) Appl. No.: 16/747,566

(22) Filed: Jan. 21, 2020

Related U.S. Application Data

(60) Provisional application No. 62/949,450, filed on Dec. 18, 2019.

(51) Int. Cl.

| | |
|---|---|
| ***A47C 31/10*** | (2006.01) |
| ***A47C 31/02*** | (2006.01) |
| ***A47G 9/02*** | (2006.01) |
| ***A47G 9/04*** | (2006.01) |
| ***A47C 21/02*** | (2006.01) |

(52) U.S. Cl.
CPC ..... *A47C 31/105* (2013.01); *A47C 21/026* (2013.01); *A47C 31/023* (2013.01); *A47G 9/0246* (2013.01); *A47G 9/04* (2013.01)

(58) Field of Classification Search
CPC ..... A47C 27/002; A47C 31/105; A47C 31/02; A47C 21/02; A47G 9/0238; A47G 9/02; A47G 9/04
See application file for complete search history.

(56) References Cited

U.S. PATENT DOCUMENTS 2,210,210 A * 8/1940 Kisilew ..... A47C 31/105 5/501
3,530,487 A 9/1970 Beer
4,389,744 A * 6/1983 Monroe ..... A47G 9/02 5/496
4,440,817 A * 4/1984 Ahlm ..... A61F 5/485 428/71
5,367,729 A * 11/1994 Lazar ..... A47C 21/022 5/484
5,910,081 A * 6/1999 Graham ..... A47C 31/105 5/699
5,966,759 A * 10/1999 Sanders ..... A47C 27/007 5/497
6,088,858 A * 7/2000 Juster ..... A47C 21/022 5/496
6,618,880 B1 9/2003 Chase
6,804,848 B1 * 10/2004 Rose ..... A47C 27/082 5/706
6,886,197 B1 * 5/2005 Madigan ..... A47G 9/02 5/482

(Continued)

*Primary Examiner* — Eric J Kurilla
(74) *Attorney, Agent, or Firm* — Lyman Moulton, Esq.; Moulton Patents, PLLC

(57) ABSTRACT

The disclosed mechanical bed mattress and frame encasement cover includes a top cover, a base encasement cover which overlaps frame base and two middle adjustment perimeter bands there between and an inside cover. The 5 covers and bands are separated by 4 zippered seams. The encasement cover comprises a high durometer perimeter band which overlaps an outer and a lower edge of the bed base. A zipper is located on a lower inner edge of the bed frame pad. An inner zipper is disposed on all 4 sides on a top side of the bed frame base pad. A zipper direction to a foot of the cover and a zipper direction to a head of the cover allow bidirectional enclosure of the bed frame and mattress. The cover wrap direction and perimeter bands enable a secure cover of the bed frame and mattress for less movement during bed dynamics.

12 Claims, 7 Drawing Sheets

(56) References Cited

U.S. PATENT DOCUMENTS

| | | | | |
|---|---|---|---|---|
| 8,671,478 | B2 * | 3/2014 | Rippe | A47C 21/022 24/72.5 |
| 8,719,977 | B2 * | 5/2014 | Rabbany | A47C 31/105 5/496 |
| 9,301,622 | B2 | 4/2016 | Kozel | |
| 10,010,191 | B1 * | 7/2018 | Patel | A01M 1/14 |
| 10,368,654 | B2 * | 8/2019 | Sopher | A47C 21/028 |
| 10,413,082 | B2 * | 9/2019 | Lava | A47C 27/002 |
| 2006/0053553 | A1 * | 3/2006 | Gomeh | A47C 21/022 5/502 |
| 2007/0022540 | A1 * | 2/2007 | Hochschild | A47C 27/15 5/727 |
| 2012/0066835 | A1 | 3/2012 | Kelly | |
| 2012/0117728 | A1 * | 5/2012 | O'Neill | A47C 31/007 5/499 |
| 2012/0137434 | A1 * | 6/2012 | Dusaj | A47G 9/0246 5/499 |
| 2012/0186016 | A1 * | 7/2012 | Martin | A47G 9/0253 5/490 |
| 2017/0332805 | A1 | 11/2017 | Hagglund | |
| 2018/0360228 | A1 * | 12/2018 | Johannessen | A47C 27/081 |

* cited by examiner

MECHANICAL BED MATTRESS AND FRAME ENCASEMENT COVER

CROSS REFERENCE TO RELATED APPLICATION

This application claims the benefit of the priority date of earlier filed U.S. Provisional Patent Application Ser. No. 62/949,450 filed Dec. 18, 2019 by Gary Kinion and is incorporated herein by reference in its entirety.

BACKGROUND AND FIELD OF INVENTION

Bed frames for flat profile bases with sliding rails to fit multiple size beds are commonplace. The transition from a single to a twin and to a full can be made with larger side rails in a frame without the need for a center post required in a queen bed or in a king bed. However, bed frames for adjustable tilt beds are built to a specific bed size due to the complexity of the tilting frame and a user's preference for adjusting a back support, a hip support and leg rest.

Tilt beds avoid the drawbacks of conventional flat mattresses which are not very good at disturbing the body's weight. As a result, pressure hot spots develop along a sleeper's body. Sleepers toss and turn from one position to another, mainly to relieve these pressure points, which occur at various places along the body where one comes into contact with a mattress. If these pressure points could be alleviated or removed all together then a sleeper may be able to avoid tossing and turning during sleep and stay sleeping. Many people actually wake themselves from sleep as they reposition themselves to become more comfortable. This, obviously, is not conducive to sound sleep. It is therefore desirable that the body be relieved of the need to frequently change positions without actually having to be physically repositioned.

Some sleep experts have reported that the average person tosses and turns 40-60 times during the night. According to multiple scientific sleep studies, more than 70 million Americans may suffer from sleep disorders, such as acid reflux, inflammation, insomnia, sleep apnea, general stress related issues, toxicity, and other health related problems. Sleepers with these conditions experience difficulty initiating or maintaining sleep, often resulting in impaired daytime functioning. In one poll, 35 percent of all adults experienced sleep disorder symptoms every night, with 58 percent reporting insomnia at least a few nights per week. Additionally, more than 100 million Americans are, by definition, chronically sleep-deprived.

However, much of the bedding industry has sought to solve the problem of a body's weight bearing down on a flat, non-moving bed surface by either softening or contouring mattress surfaces. There are hundreds of inventive ideas in the prior art dealing with the improvement of the sleep surface but none have been found that seek to move the mattress in ways that preclude a sleeper from having to reposition themselves during sleep and offer therapeutic benefits at the same time.

SUMMARY OF THE INVENTION

A disclosed mechanical bed mattress and frame encasement cover includes a top cover, a base cover (overlaps frame base) and two middle adjustment perimeter bands there between. The encasement cover also includes a base cover and a bed frame base or inside cover. The 5 covers and bands are separated by 4 zippered seams. The encasement cover comprises a high durometer fabric which overlaps an outer and a lower edge of the bed base. A zipper is located on a lower inner edge of the bed frame pad. An inner zipper is disposed on all 4 sides on a top side of the bed frame base pad. A zipper direction to a foot of the cover and a zipper direction to a head of the cover allow bidirectional enclosure of the bed frame and mattress. A cover wrap direction enables a secure cover of the bed frame and mattress for less movement.

The disclosed bed cover includes a base encasement comprising a high durometer perimeter band configured to cover a mechanical bed frame, a bed base and a portion of a bed mattress. The bed cover also includes a plurality of expandable adjustment perimeter bands configured to attach to the base encasement via a plurality of attachments and expand a height or a volume covered by the bed cover. The bed cover further includes a top cover comprising a low durometer material and configured to attach to an adjacent one of the plurality of expandable adjustment perimeter bands via an attachment. The bed cover yet includes an inside cover configured to cover an underside of the mechanical bed frame and the bed base and attach to the base encasement via a perimeter zipper A disclosed method of covering a bed, the method includes covering 210 a mechanical bed frame and a bed base and a portion of a bed mattress via a base encasement comprising a high durometer perimeter band. The method also includes expanding 220 a volume covering the bed via a plurality of expandable adjustment perimeter bands configured to attach to the base encasement via a plurality of attachments. The method additionally includes attaching 230 a top cover comprising a low durometer material to the plurality of expandable adjustment perimeter bands via an attachment. The method further includes covering 240 an underside of the mechanical bed frame and the bed base via an inside cover attached to the base encasement via a perimeter zipper.

Other aspects and advantages of embodiments of the disclosure will become apparent from the following detailed description, taken in conjunction with the accompanying drawings, illustrated by way of example of the principles of the disclosure.

Figure 1:
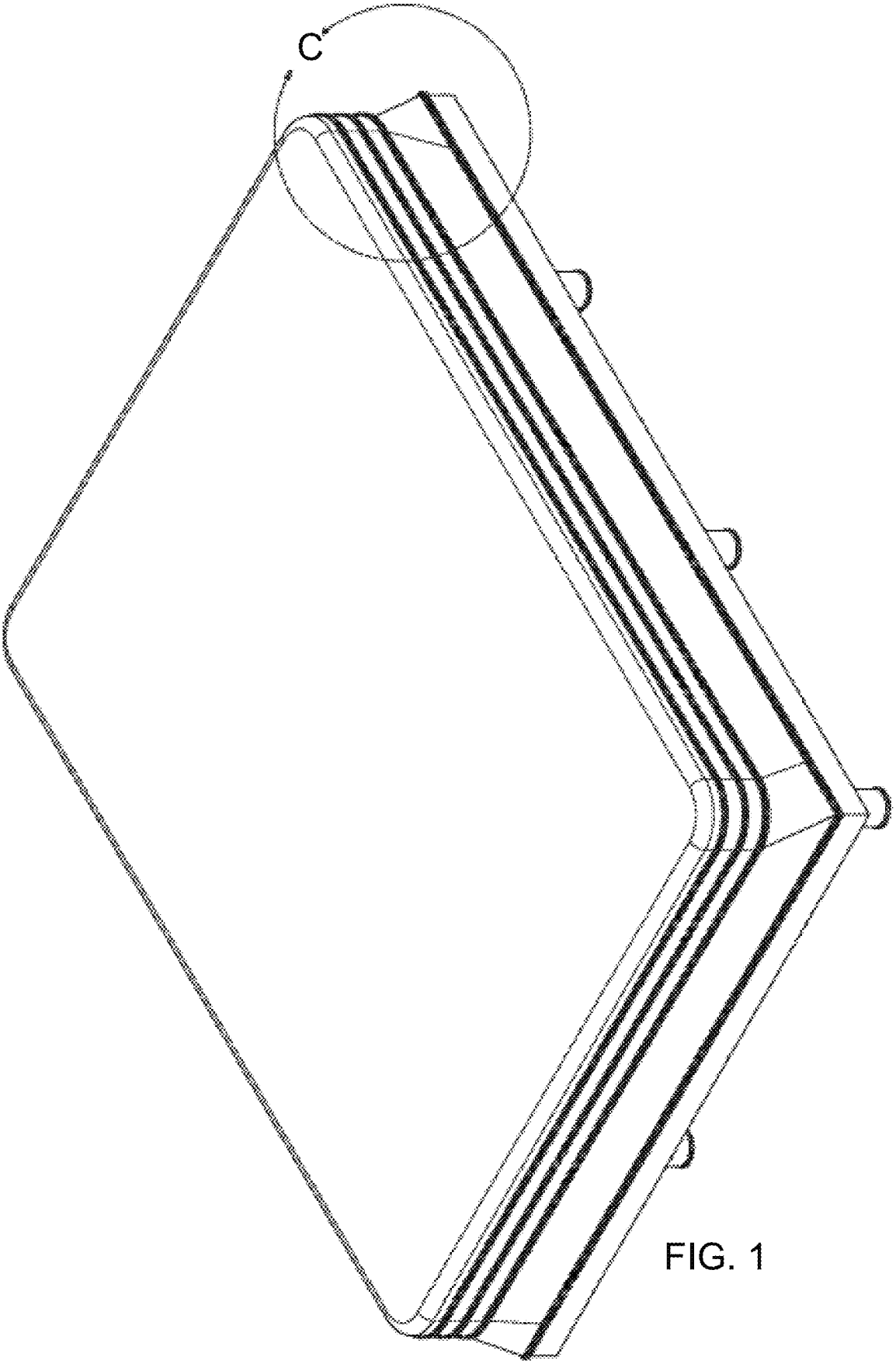
FIG. 1 is an orthogonal depiction of the mechanical bed mattress and frame encasement cover in accordance with an embodiment of the present disclosure.

Throughout the description, same and similar reference numbers may be used to identify same and similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure, the term 'mechanical bed' refers to an adjustable bed not unlike those in hospitals and in homes which allow a user to form a bed to a comfort profile for reading, resting and watching TV and laptop use. The term 'encasement' refers throughout the disclosure to a structure similar to an expandable luggage applied to enclose a mechanical bed of a dynamic and continuously moving motion similar to a rocking cradle. The term 'band,' throughout the present disclosure refers to a continuous perimeter loop of material. The term 'height,' refers to a direction orthogonal to a sleeping surface plane of the bed, mattress and frame. The term, 'perimeter,' refers to the outer edge of the bed mattress, frame or base orthogonal to the sleeping surface plane. The term, 'adjustment perimeter band,' and the term, 'expandable adjustment perimeter band,' are used interchangeably and synonymously in the present disclosure.

The disclosed mechanical bed mattress and frame encasement cover includes a top cover, a base cover (overlaps frame base) and two middle adjustment covers there between. The encasement cover also includes a base cover and a bed frame base or inside cover. The 5 covers are separated by 4 zippered seams. The encasement cover comprises a high durometer fabric which overlaps an outer and a lower edge of the bed base. A zipper is located on a lower inner edge of the bed frame pad. An inner zipper is disposed on all 4 sides on a top side of the bed frame base pad. A zipper direction to a foot of the cover and a zipper direction to a head of the cover allow bidirectional enclosure of the bed frame and mattress. A cover wrap direction enables a secure cover of the bed frame and mattress for less movement.

FIG. 1 is an orthogonal depiction of the mechanical bed mattress and frame encasement cover in accordance with an embodiment of the present disclosure. The depiction includes the detail of subarea C.

Figure 2:
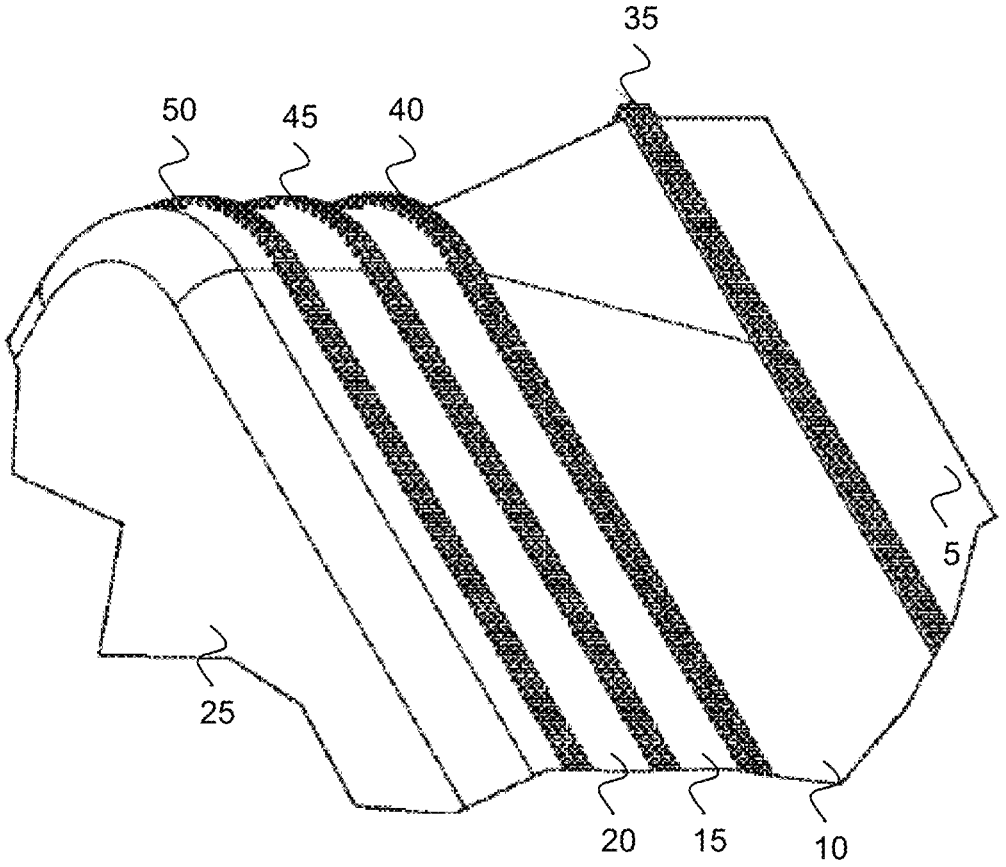
FIG. 2 is a depiction of subarea C of FIG. 1 of the mechanical bed mattress and frame encasement cover in accordance with an embodiment of the present disclosure.

FIG. 2 is the depiction of subarea C of the mechanical bed mattress and frame encasement cover in accordance with an embodiment of the present disclosure. The depiction includes the base encasement 10, the expandable adjustment perimeter bands 15 and 20 and the top cover 25. The depiction also includes the zippers 35, 40, 45 and 50 connecting or offsetting the base encasement, expandable adjustment perimeter bands and the top cover respectively. The inside cover 5 runs from the encasement base under the bed frame and mattress and base.

Figure 3:
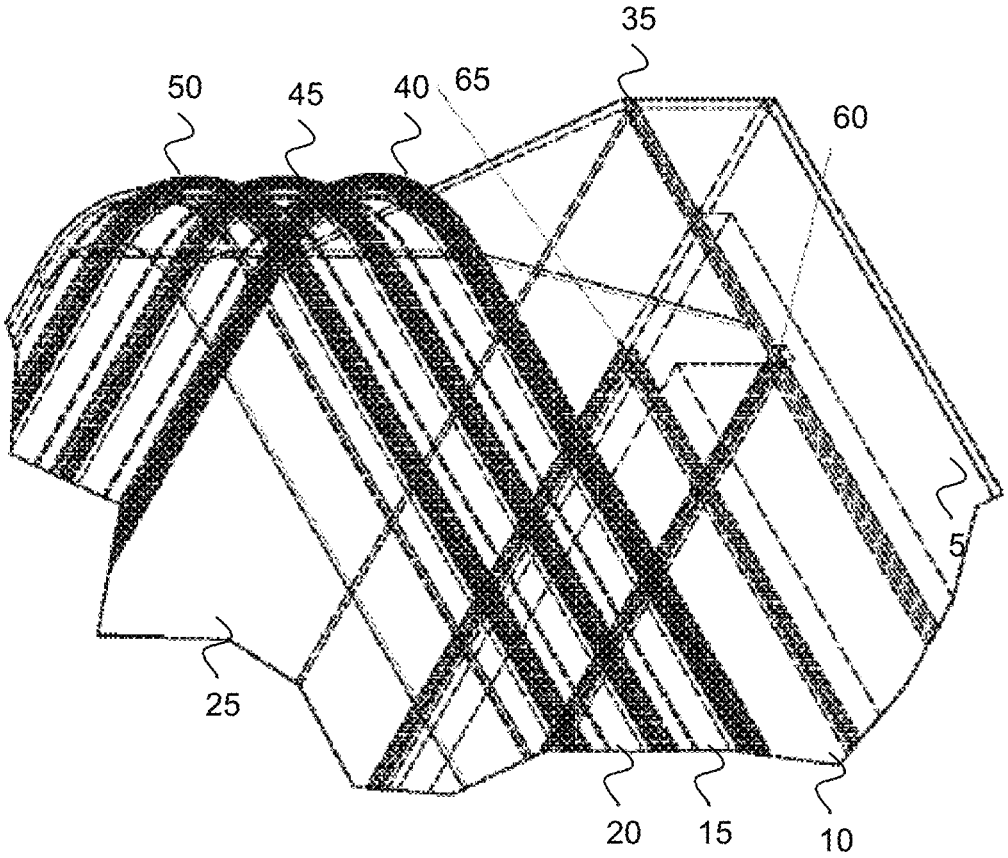
FIG. 3 is a see through depiction of subarea C of FIG. 1 of the mechanical bed mattress and frame encasement cover in accordance with an embodiment of the present disclosure.

FIG. 3 is a see through depiction of subarea C of the mechanical bed mattress and frame encasement cover in accordance with an embodiment of the present disclosure. The depiction includes the reference lines and reference numbers of FIG. 2 and in addition includes the girth zippers 60 and 65.

Figure 4:
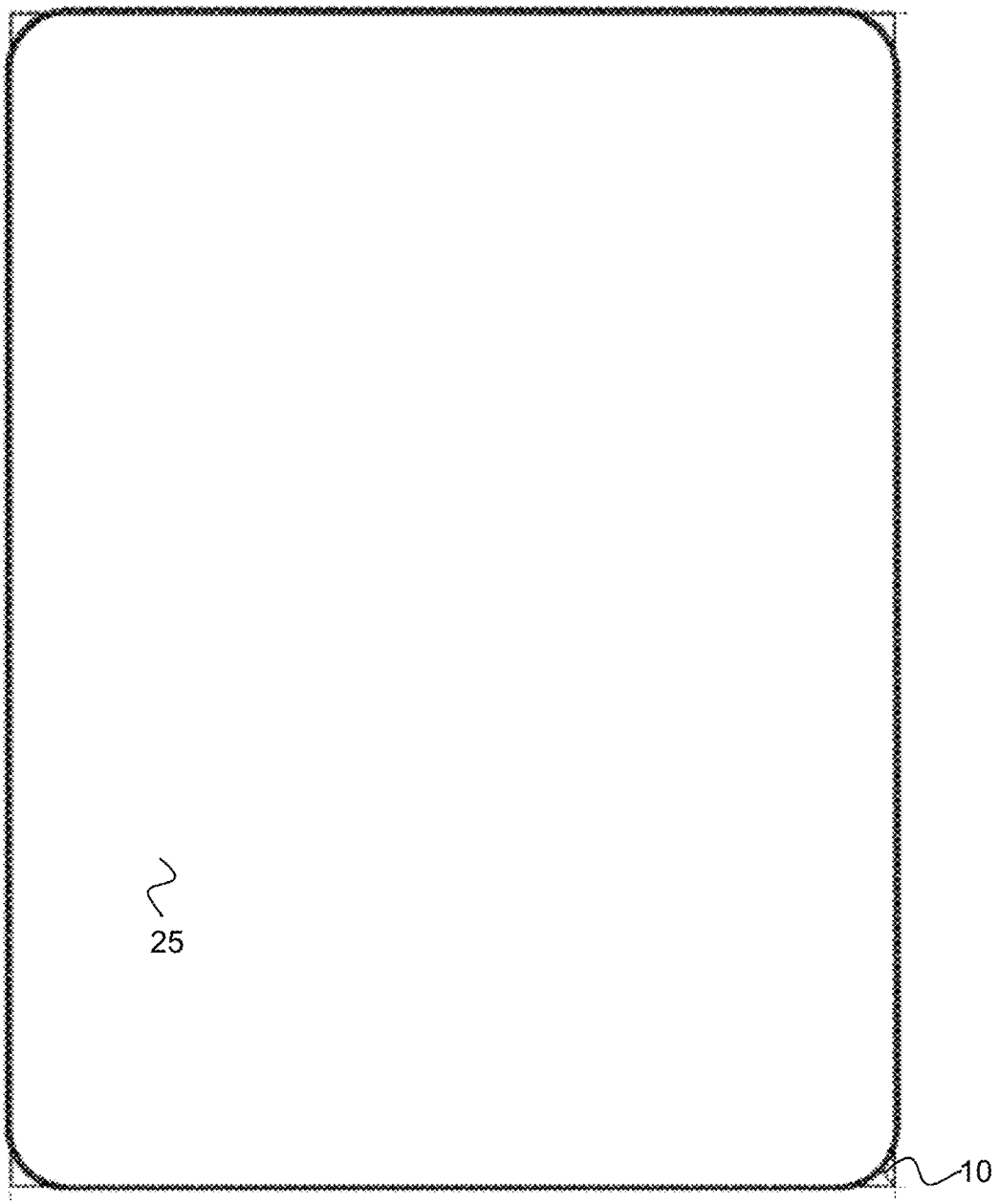
FIG. 4 is a top elevational depiction of the mechanical bed mattress and frame encasement cover in accordance with an embodiment of the present disclosure.

FIG. 4 is a top elevational depiction of the mechanical bed mattress and frame encasement cover in accordance with an embodiment of the present disclosure. The depiction includes the top cover 25 and the base encasement 10.

Figure 5:
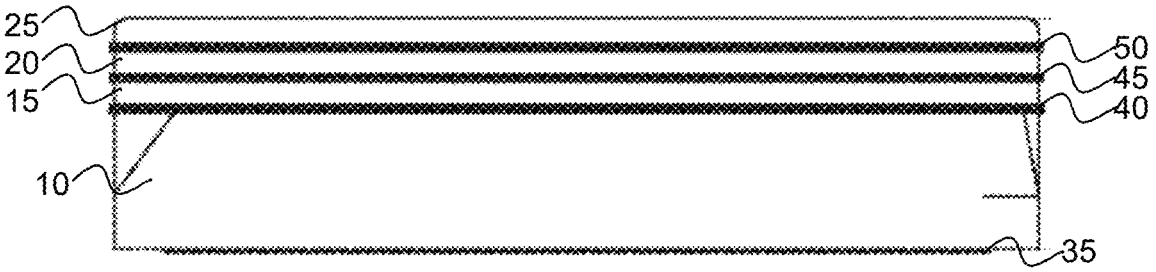
FIG. 5 is a side elevational depiction of the mechanical bed mattress and frame encasement cover in accordance with an embodiment of the present disclosure.

FIG. 5 is a side elevational depiction of the mechanical bed mattress and frame encasement cover in accordance with an embodiment of the present disclosure. The depiction includes the zipper 35 which connects the inside cover to the base encasement. The zipper 35 runs an inside perimeter of the bed base short of the outside perimeter of the bed frame and mattress. Other reference lines and reference numbers are same and similar to those of other figures.

Figure 6:
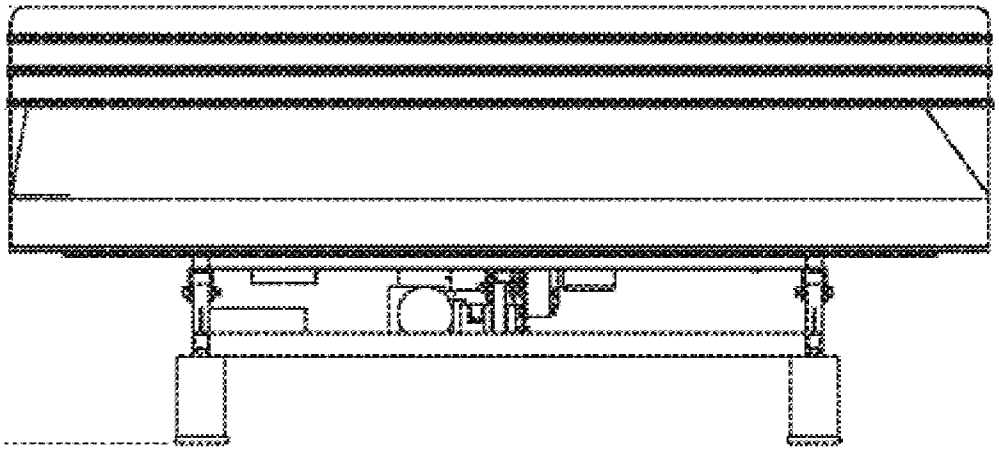
FIG. 6 is an end elevational depiction of the mechanical bed mattress and frame encasement cover and supporting mechanical system in accordance with an embodiment of the present disclosure.

FIG. 6 is an end elevational depiction of the mechanical bed mattress and frame encasement cover and supporting mechanical system in accordance with an embodiment of the present disclosure. The supporting mechanical system sits on pillars or legs and can rock the bed back and forth from head to foot or from side to side and can bend at angles to support a person in an ergonomic posture.

Figure 7:
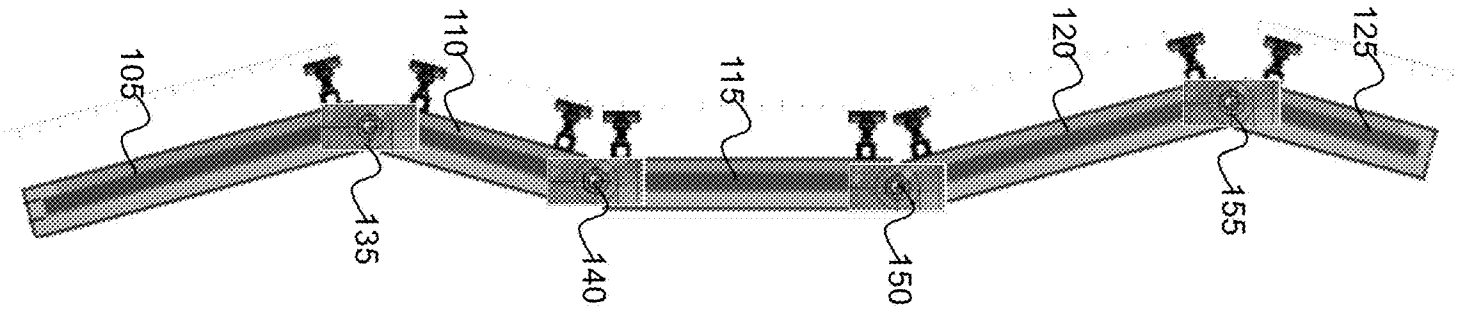
FIG. 7 is a side view of a expandable adjustment portion in a bent position via pleats in accordance with an embodiment of the present disclosure.

FIG. 7 is a side view of a expandable adjustment perimeter band in a bent position via pleats in accordance with an embodiment of the present disclosure. The depiction includes a first section 105, a second section 110, a third section 115, a fourth section 120 and a fifth section 125. The depiction also includes the pleated sections 135, 140, 150 and 155 respectively there between.

A disclosed bed cover includes a base encasement comprising a high durometer perimeter band configured to cover a mechanical bed frame, a bed base and a portion of a bed mattress. The bed cover also includes a plurality of expandable adjustment perimeter bands configured to attach to the base encasement via a plurality of attachments and expand a height or a volume covered by the bed cover. The bed cover further includes a top cover comprising a low durometer material and configured to attach to an adjacent one of the plurality of expandable adjustment perimeter bands via an attachment.

An embodiment of the bed cover includes an inside cover configured to cover an underside of the mechanical bed frame and the bed base and attach to the base encasement via a perimeter zipper. A girth zipper in each of the base encasement, the plurality of expandable adjustments and the top cover are configured to expand a length thereof.

Further embodiments the attachment(s) are zippers, turn button eyelet and stud fasteners, hook and loop fasteners, snap and post fasteners and eyelet and hook fasteners. The expandable adjustment perimeter bands include a laterally gathered fabric continuous with a perimeter wall of the base encasement and one of the top cover and another expandable adjustments. Other embodiments of the expandable adjustment perimeter bands completely detach from the base encasement and one of the top cover and another expandable adjustment perimeter band.

Figure 8:
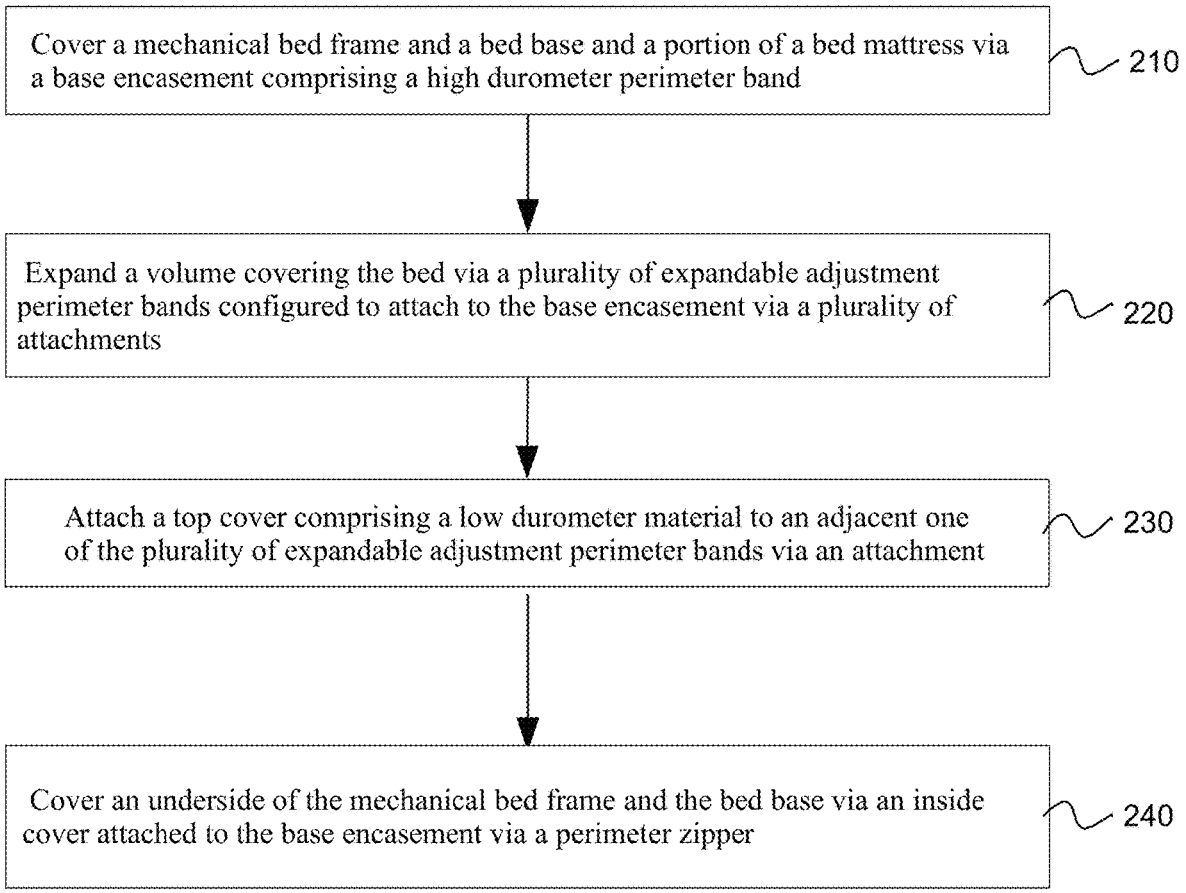
FIG. 8 is a flow chart of a method of covering a mechanical bed frame and mattress via an encasement cover in accordance with an embodiment of the present disclosure.

FIG. 8 is a flow chart of a method of covering a mechanical bed frame and mattress via an encasement cover in accordance with an embodiment of the present disclosure. A method of covering a bed, the method includes covering 210 a mechanical bed frame and a bed base and a portion of a bed mattress via a base encasement comprising a high durometer perimeter band. The method also includes expanding 220 a volume covering the bed via a plurality of expandable adjustment perimeter bands configured to attach to the base encasement via a plurality of attachments. The method additionally includes attaching 230 a top cover comprising a low durometer material to the plurality of expandable adjustment perimeter bands via an attachment. The method further includes covering 240 an underside of the mechanical bed frame and the bed base via an inside cover attached to the base encasement via a perimeter zipper.

Embodiments of the method include expanding a length of the base encasement, the plurality of expandable adjustments and the top cover each via a girth zipper with gathered material between zipper halves thereof. The embodiments further include expanding the adjustments via a laterally gathered fabric continuous with a perimeter wall of the base encasement and one of the top cover and another expandable adjustment. The method embodiments yet include completely detaching each of the expandable adjustment perimeter bands from the base encasement and one of the top cover and another expandable adjustment.

Embodiments of the base encasement further include a plurality of lateral pleats in the base encasement configured to allow it to bend with the mechanical bed frame. Also embodiments of the base encasement include a hard wall perimeter configured to rigidly retain the bed mattress. Embodiments of the plurality of expandable adjustments include a plurality of high durometer material side walls.

The disclosure works well with Sealy Posturpedic, Sleep Number, Serta, Simmons, Pillow top, Denver Mattress Company, Leggett and Platt, as well as every other commercially available mattress, base, box springs and frame brands.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A bed cover, comprising:

a) a base encasement comprising high durometer perimeter band configured to encircle a mechanical bed frame, a bed base and a portion of a bed mattress;

b) a plurality of adjustment perimeter bands configured to attach to the base encasement via a plurality of attachments and expand a height covered by the bed cover, wherein the adjustment perimeter bands comprise a laterally gathered fabric continuous with a perimeter wall of the base encasement and one of the top cover and an adjacent adjustment perimeter band;

c) a top cover comprising a low durometer material and configured to attach to an adjacent one of the plurality of adjustment perimeter bands via an attachment; and d) a girth zipper in each of the base encasement, the plurality of adjustment perimeter bands and the top cover configured to expand a respective length thereof.

2. The bed cover of claim 1, further comprising an inside cover configured to cover an underside of the mechanical bed frame, the bed base and attach to the base encasement via a perimeter zipper.

3. The bed cover of claim 2, wherein the attachment(s) are zippers.

4. The bed cover of claim 2, wherein the attachment(s) are turn button eyelet and stud fasteners.

5. The bed cover of claim 2, wherein the attachment(s) are hook and loop fasteners.

6. The bed cover of claim 2, wherein the attachment(s) are snap and post fasteners.

7. The bed cover of claim 2, wherein the attachment(s) are eyelet and hook fasteners.

8. The bed cover of claim 2, wherein each of the adjustment perimeter bands completely detach from the base encasement and one of the top cover and an adjacent adjustment perimeter band.

9. A method of covering a bed, the method comprising:

a) covering a mechanical bed frame, a bed base and a portion of a bed mattress via a base encasement comprising a high durometer perimeter band;

b) expanding the covering of the bed via a plurality of adjustment perimeter bands configured to attach to the base encasement via a plurality of attachments;

c) attaching a top cover comprising a low durometer material to the plurality of adjustment perimeter bands via an attachment;

d) expanding a length of the base encasement, the plurality of adjustment perimeter bands and the top cover via a girth zipper in each; and e) expanding the adjustment perimeter bands via a laterally gathered fabric continuous with a perimeter wall of the base encasement and one of the top cover and an adjacent adjustment perimeter band.

10. The method of claim 9, further comprising expanding and attaching via zippers and a material perimeter band there between.

11. The method of claim 9, further comprising expanding and attaching via one of turn button eyelet and stud fasteners, hook and loop fasteners, snap and post fasteners and eyelet and hook fasteners.

12. The method of claim 9, further comprising completely detaching each of the adjustment perimeter bands from the base encasement and one of the top cover and an adjacent adjustment perimeter band.

* * * * *